US009328475B2

(12) United States Patent
Sawaishi et al.

(10) Patent No.: US 9,328,475 B2
(45) Date of Patent: May 3, 2016

(54) STEEL PIPE PILE AND STEEL PIPE PILE IMPLEMENTATION METHOD

(75) Inventors: Masamichi Sawaishi, Tokyo (JP); Masatoshi Wada, Tokyo (JP)

(73) Assignee: NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 95 days.

(21) Appl. No.: 13/994,929

(22) PCT Filed: Jul. 9, 2012

(86) PCT No.: PCT/JP2012/067461

§ 371 (c)(1),
(2), (4) Date: Jun. 17, 2013

(87) PCT Pub. No.: WO2013/027503

PCT Pub. Date: Feb. 28, 2013

(65) Prior Publication Data

US 2013/0272801 A1 Oct. 17, 2013

(30) Foreign Application Priority Data

Aug. 25, 2011 (JP) ..... 2011-183987

(51) Int. Cl.
*E02D 5/56* (2006.01)
*E02D 5/28* (2006.01)
*E02D 7/22* (2006.01)

(52) U.S. Cl.
CPC ... *E02D 5/56* (2013.01); *E02D 7/22* (2013.01)

(58) Field of Classification Search
CPC ..... E02D 5/28; E02D 5/56; E02D 7/22
USPC ..... 405/229, 231, 232, 249, 252.1, 253; 175/323, 394; 52/153, 154, 157
See application file for complete search history.

(56) References Cited

U.S. PATENT DOCUMENTS 1,857,585 A * 5/1932 Brooks, Sr. ..... 175/18
2,395,033 A * 2/1946 Black ..... 52/157

(Continued)

FOREIGN PATENT DOCUMENTS

CN 1510218 A 7/2004
CN 1536171 A 10/2004

(Continued)

OTHER PUBLICATIONS

International Search Report issued in International Patent Application No. PCT/JP2012/067461 mailed Aug. 14, 2012.

(Continued)

*Primary Examiner* — Benjamin Fiorello
*Assistant Examiner* — Stacy Warren
(74) *Attorney, Agent, or Firm* — Oliff PLC

(57) ABSTRACT

A steel pipe pile includes an elongated cylindrical steel pipe pile body with an open end and a helical wing fixed on an outer circumference of the pile body at a predetermined height range from the open end. The wing includes a wing edge extending outward from the outer circumference of the open end, and a wing body extending continuously with the wing edge and extending helically along the outer circumference and toward an upper side of the pile body. The open end includes an opening slanted in a radial direction of the pile body and a distal backside that is defined by a remaining circumference of the pile body. An upper end of the slanted opening is above the wing edge, and the distal backside has a point intersecting with a line orthogonal to a line connecting the wing edge and a center of the pile body.

4 Claims, 5 Drawing Sheets

(56) References Cited

U.S. PATENT DOCUMENTS

| | | | | |
|---|---|---|---|---|
| 4,790,689 | A * | 12/1988 | Henn et al. | 405/240 |
| 5,240,353 | A * | 8/1993 | Bower et al. | 405/259.1 |
| 7,004,683 | B1 * | 2/2006 | Rupiper | 405/229 |
| 2007/0243025 | A1 * | 10/2007 | Ronnkvist | 405/244 |
| 2009/0180838 | A1 * | 7/2009 | Ronnkvist | 405/251 |

FOREIGN PATENT DOCUMENTS

| | | | |
|---|---|---|---|
| CN | 2869128 | Y | 2/2007 |
| JP | 02194212 | A * | 7/1990 |
| JP | U-4-41526 | | 4/1992 |
| JP | A-2002-348862 | | 12/2002 |
| JP | A-2004-316238 | | 11/2004 |
| JP | 2007113270 | A * | 5/2007 |
| WO | WO 2010116884 | A1 * | 10/2010 |

OTHER PUBLICATIONS

Feb. 15, 2015 Office Action issued in China application No. 201280007259.8.

* cited by examiner

STEEL PIPE PILE AND STEEL PIPE PILE IMPLEMENTATION METHOD

TECHNICAL FIELD

The present invention relates to a steel pipe pile and an installation method of a steel pipe pile. More specifically, the invention relates to a steel pipe pile including an elongated cylindrical steel pipe pile body and a helical wing fixed on an outer circumference of the steel pipe pile body at least in a predetermined height range from an end of the steel pipe pile body, and an installation method of a steel pipe pile that is penetrated into the ground by rotational drive.

BACKGROUND ART

Conventionally, a steel pipe pile including a helical projection on an outer circumference of a steel pipe and being driven into the ground by rotary penetration has been proposed (see, for instance, Patent Literature 1).

An end of the steel pipe of the steel pipe pile is obliquely cut at a slant angle of 10 to 50 degrees. With the cut region being provided, a pushing-in performance into the ground can be enhanced and a penetration resistance can be restrained, thereby improving an installation efficiency of the steel pipe pile.

CITATION LIST

Patent Literature

Patent Literature JP-U-4-41526

SUMMARY OF THE INVENTION

Problems to be Solved by the Invention

The protrusion amount of the helical projection of the conventional steel pipe pile disclosed in Patent Literature 1 is small. Accordingly, since the projection provides not so high entering performance into the ground, even when the end cut region is provided, there is a certain limit in improvement in the installation efficiency. On the other hand, another example of a known steel pipe pile includes a helical wing fixed on an outer circumference of a steel pipe. With the use of such a steel pipe pile, since the wing bites into the ground for entering, the penetration performance can be enhanced, and a further improvement in the installation efficiency can be expected. However, since the wing receives a resistance from the ground, the steel pipe pile rotates around the wing (i.e. become off-centered), so that it is difficult to ensure a linearity especially in an initial stage of the penetration.

An object of the invention is to provide a steel pipe pile and an installation method of a steel pipe pile capable of enhancing penetration performance while ensuring linearity during penetration, thereby improving an installation efficiency.

Means for Solving the Problems

A steel pipe pile according to an aspect of the invention includes: an elongated cylindrical steel pipe pile body with an open end; and a helical wing fixed on an outer circumference of the steel pipe pile body at a predetermined height range from the end of the steel pipe pile body, the steel pipe pile being rotationally driven to be penetrated into a ground, in which the end of the steel pipe pile body is provided with a slanted opening defined by upwardly obliquely cutting the steel pipe pile body toward a first side in a radial direction of a distal end, and a distal backside defined by a remaining circumference of the steel pipe pile body on a second side in the radial direction relative to the slanted opening, the wing is provided with a wing edge extending outward in a manner intersecting the outer circumference of the distal end of the steel pipe pile body and a wing body continuous with the wing edge and extending in one circumferential direction and toward an upper side, and the distal backside is provided at an area near the second side substantially orthogonal to a line connecting a part of the wing edge and a center of the steel pipe pile body, the distal backside being located near the wing body relative to the wing edge.

According to the above aspect of the invention, the distal backside is provided at an area substantially orthogonal to the direction of the wing edge and near the wing body relative to the wing edge. In other words, the distal backside is located at a rear side in the rotational direction relative to the wing edge that initially bites into the ground when the wing enters the ground. Accordingly, when the steel pipe pile is rotationally driven into the ground, a resistance force can be applied at the distal backside against a rotation moment for biasing the entirety of the steel pipe pile to rotate around the wing edge receiving the resistance from the ground, so that the steel pipe pile can be penetrated into the ground while avoiding an off-centered movement of the steel pipe pile and ensuring linearity. Further, since the slanted opening is provided radially opposite to the distal backside, i.e. at the front side of the wing edge in the entering direction, the soil excavated in accordance with the rotational drive into the ground can be smoothly introduced into the steel pipe pile body through the slanted opening. Thus, while restraining the ground resistance in accordance with the entering, the soil introduced into the steel pipe pile body can be pushed upward, thereby reducing an increase in the penetration resistance caused by clogging within the pipe.

In the steel pipe pile according to the above aspect of the invention, it is preferable that an end of the slanted opening is located at an area past a center of the distal end of the steel pipe pile body.

Further, it is preferable that an upper end of the slanted opening is located in an area of the steel pipe pile body at a distance from one to three times as long as a diameter of the steel pipe pile body from the distal end of the steel pipe pile body.

According to the above arrangements, while enhancing penetrability into the ground by sharpening the end of the steel pipe pile body by providing the end of the slanted opening at the area past the center of the distal end of the steel pipe pile body, a certain opening area of the slanted opening can be ensured by making the distance to the upper end point of the slanted opening larger than the diameter of the steel pipe pile, thereby enhancing introduction performance of the excavated soil. Accordingly, since the penetration resistance can be restrained while enhancing penetrability, the installation efficiency can be improved.

Further, it is preferable that a length from a lower surface of the wing edge to the distal end of the distal backside is defined to be equal to or larger than a half of a width of the wing.

According to the above arrangement, since the distance from the lower surface of the wing edge to the distal backside is kept at or more than a predetermined length, the penetrability into the ground can be further enhanced and linearity can be improved.

On the other hand, an installation method according to another aspect of the invention is for installing the steel pipe pile of the above aspect of the invention, the method including: sticking the distal backside of the steel pipe pile into the ground to position the steel pipe pile; and rotating the steel pipe pile body to penetrate the ground with the wing entering into the ground.

According to the above aspect of the invention, after sticking the distal backside into the ground for positioning, the steel pipe pile body is rotated to be entered with the wing. Thus, since the rotation of the entirety of the steel pipe pile can be restrained by the resistance force of the distal backside as described above, the steel pipe pile can be installed at a predetermined point without causing misalignment of the center of the pile after being positioned. In addition, the penetration performance can be enhanced with the progressive drive of the wing, so that the installation efficiency can be improved.

In the steel pipe pile and the installation method of the steel pipe pile according to the above aspects of the invention, the penetration performance can be enhanced by entering the ground with the helical wing and acutely forming the end of the steel pipe pile body. Further, the penetration resistance can be restrained by introducing the excavated soil through the slanted opening. In addition, the resistance applied on the wing from the ground can be restrained from causing a rotation (off-centered movement) of the entirety of the steel pipe pile with the resistance force caused by the distal backside, so that the installation efficiency can be improved while ensuring linearity.

EXEMPLARY EMBODIMENT

Exemplary embodiment(s) of the invention will be described below with reference to the attached drawings.

Figure 1:
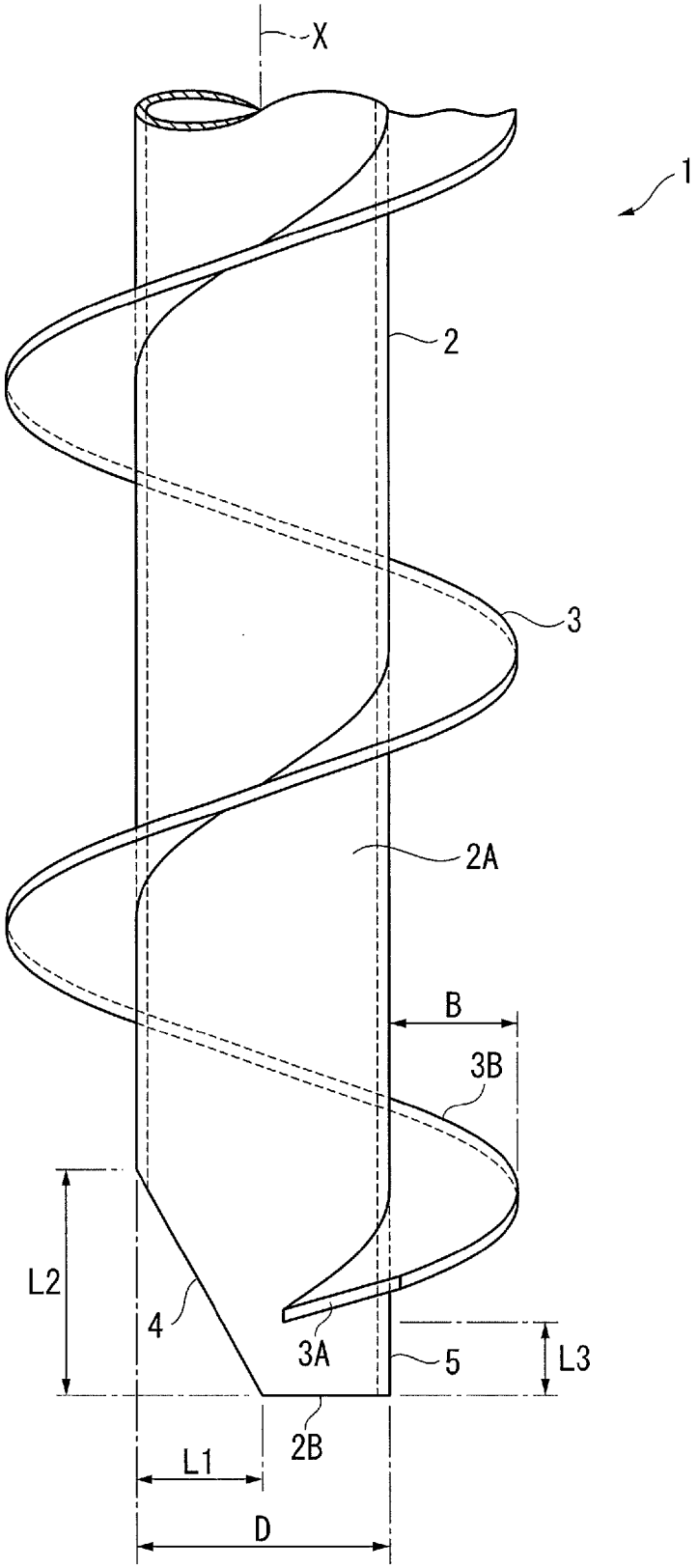
FIG. 1 is a side elevational view showing an end of a steel pipe pile according to an exemplary embodiment of the invention.

As shown in FIG. 1, a steel pipe pile 1 includes a cylindrical steel pipe pile body 2 elongated along an axial direction X and having an open end, and a helical wing 3 fixed on an outer circumference 2A of the steel pipe pile body 2 at a predetermined height range from the end of the steel pipe pile body 2. The steel pipe pile 1 gains a propelling force by the wing 3 to be penetrated into the ground being driven downward while being rotated by a rotary pile driver holding a pile head (upper part in the axial direction X). The end of the steel pipe pile body 2 is provided with a slanted opening 4 defined by upwardly obliquely cutting the steel pipe pile body 2 toward a first side (left side in FIG. 1) of a distal end 2B in a radial direction, and a distal backside 5 defined by a remaining circumference of the steel pipe pile body 2 on a second side (right side in FIG. 1) in the radial direction relative to the slanted opening 4. The wing 3 includes a wing edge 3A extending outward intersecting the outer circumference 2A near the end of the steel pipe pile body 2 and a wing body 3B extending continuously with the wing edge 3A in one circumferential direction toward an upper side. Specifically, the wing 3 is provided in a clockwise (right-hand turning) helical shape seen from the end of the steel pipe pile body 2 toward a pile head.

Figure 2:
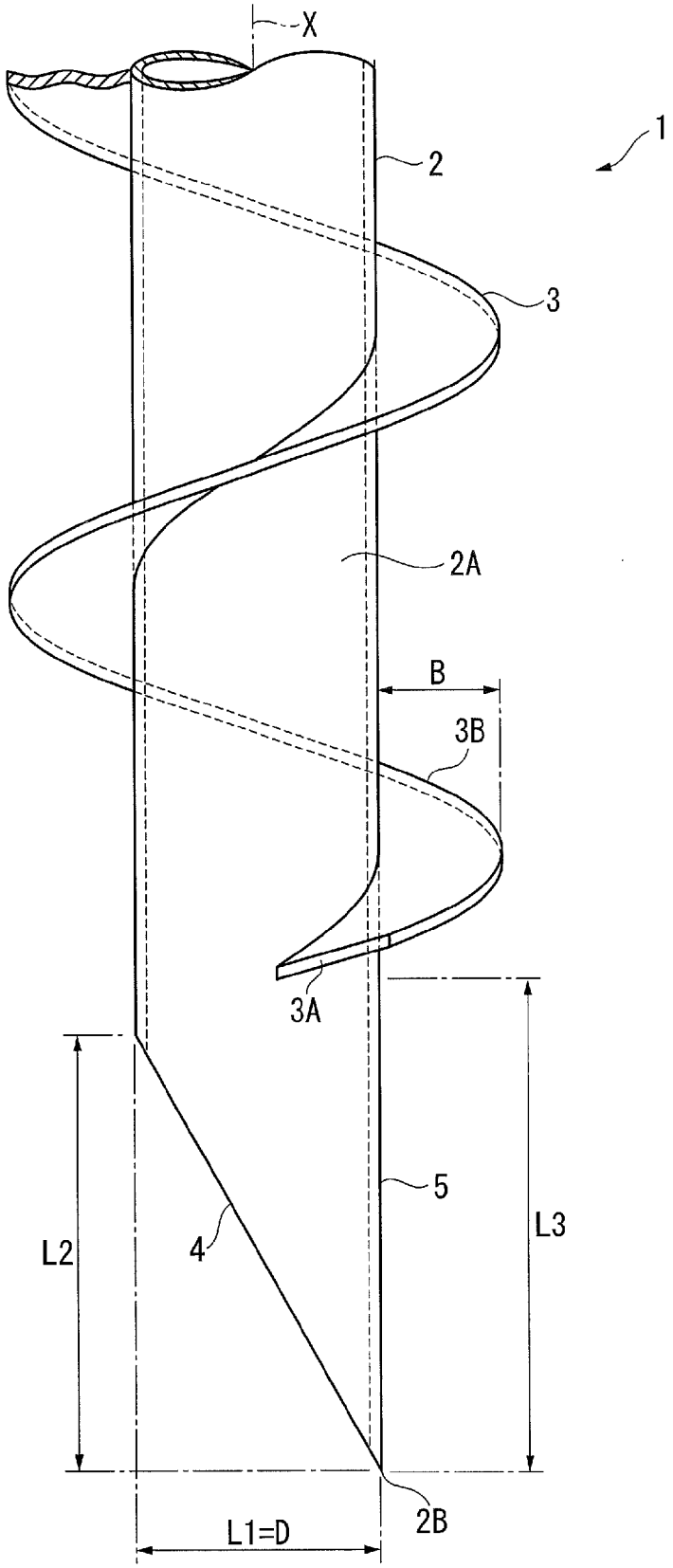
FIG. 2 is a side elevational view showing a steel pipe pile according to the exemplary embodiment with an end shape different from that in FIG. 1.

In the steel pipe pile 1 shown in FIG. 1, an end point of the slanted opening 4 is located at or over (i.e. near the second side) a middle of a diameter D of the steel pipe pile body 2 at the distal end 2B of the steel pipe pile body 2 ($L1 \geq D/2$), and an upper end point of the slanted opening 4 is located above the distal end 2B at a height equal to or larger than the diameter D ($L2 \geq D$). In addition, a distance L3 from a lower surface of the wing edge 3A to an end of the distal backside 5 is defined to be equal to or larger than a half of a width B of the wing 3 ($L3 \geq D/2$). It should be noted that each of the distances L1 and L2 is not required to be defined as shown in FIG. 1. Specifically, the distance L1 may be defined to be any length within the range from a half of the diameter D to the length of the diameter D ($D/2 \leq L1 \leq D$), and the distance L2 may be defined in a range from one to three times as long as the diameter D ($D \leq L2 \leq 3D$). For instance, the steel pipe pile 1 may be shaped as shown in FIG. 2. In the steel pipe pile 1 shown in FIG. 2, an end point of the slanted opening 4 is located near to the second side by a distance approximately equal to the diameter D of the steel pipe pile body 2 ($L1=D$), and an upper end of the slanted opening 4 is located above the distal end 2B at a height approximately twice the length of the diameter D ($L2=2D$).

Figure 3:
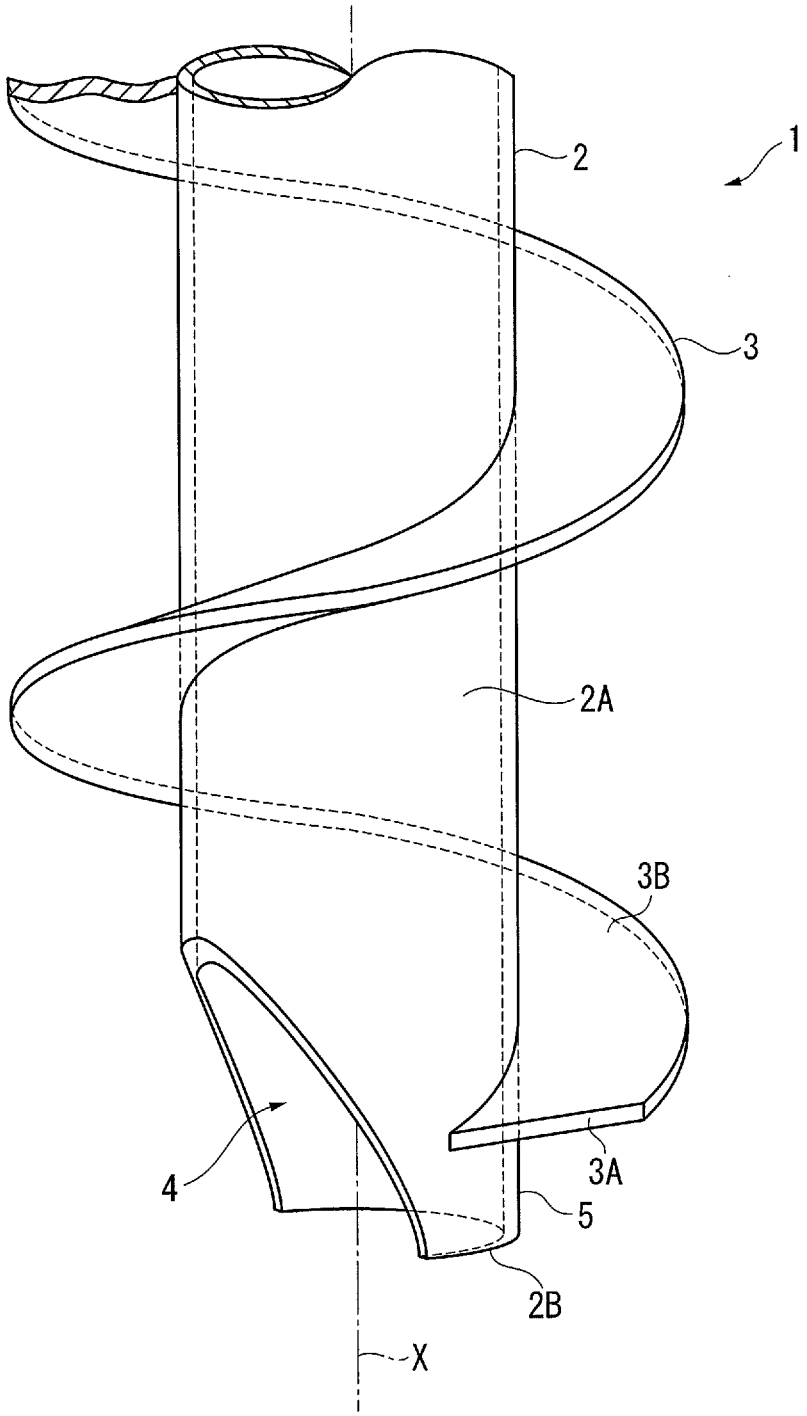
FIG. 3 is a perspective view showing the steel pipe pile.
Figure 4:
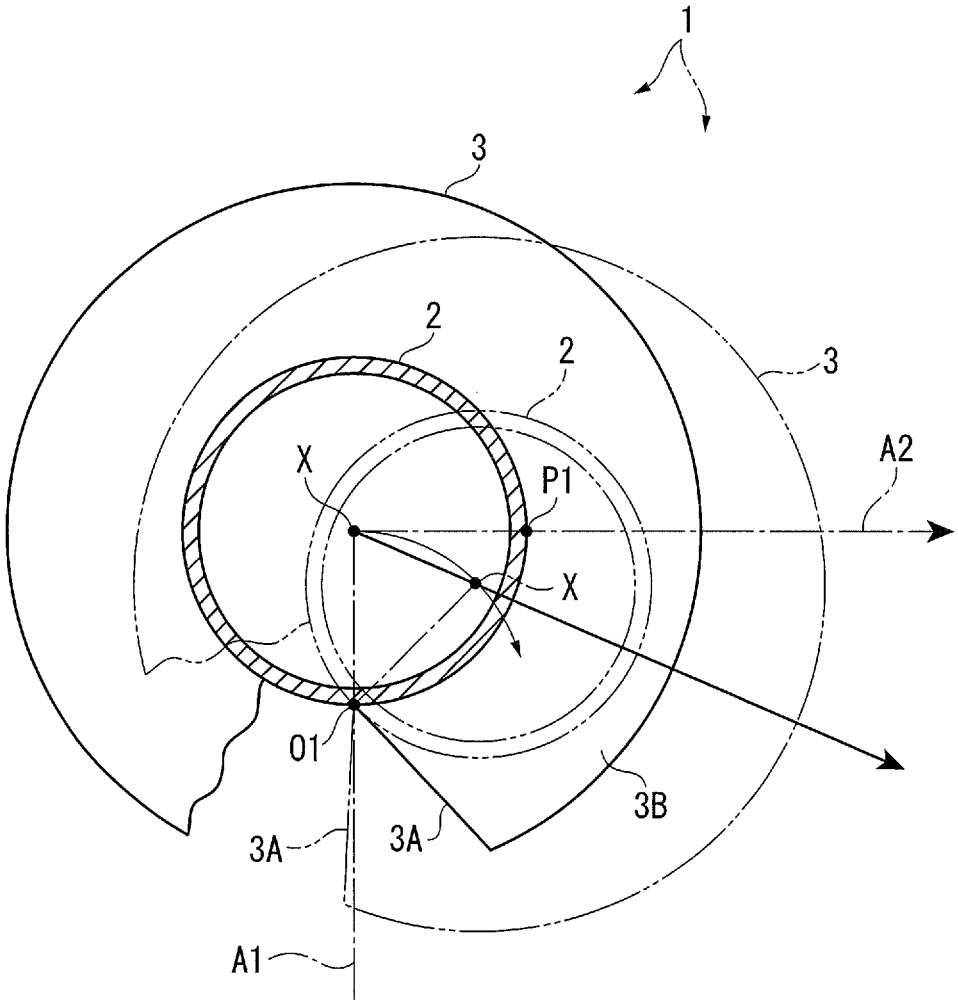
FIG. 4 is an illustration showing an effect of the steel pipe pile.
Figure 5:
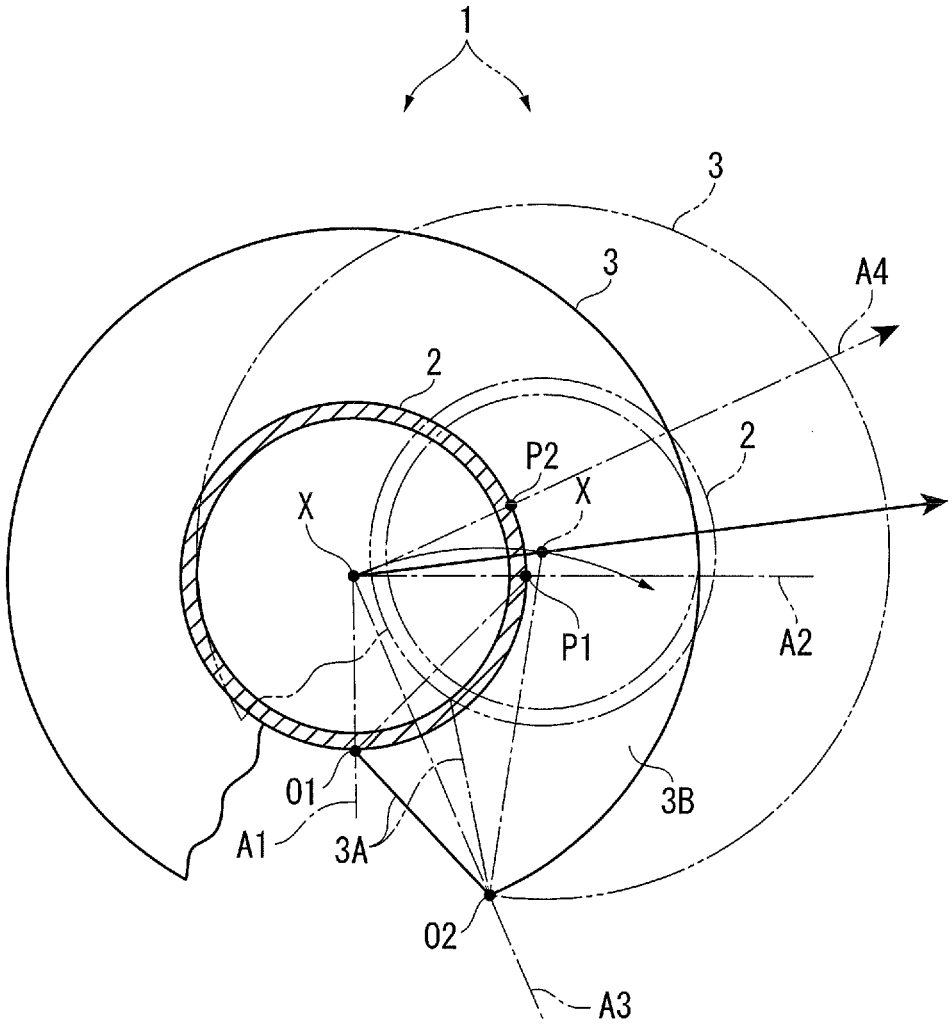
FIG. 5 is another illustration showing an effect of the steel pipe pile.

As shown in FIG. 3, the slanted opening 4 is located near a front side (first side) in the entering direction of the wing edge 3A. The distal backside 5 is located opposite to (i.e. near the second side (rear side in the entering direction)) the slanted opening 4 across the center (the position of the X-axis) of the steel pipe pile body 2. Specifically, as shown in FIG. 4, the distal backside 5 is provided to include a point P1 defined at an intersection of a line A2 (a line orthogonal to a line A1 (a line connecting a base end O1 of the wing edge 3A and the center of the steel pipe pile body 2) and extending through the center of the steel pipe pile body 2 toward the wing body 3B) and the steel pipe pile body 2. Further, as shown in FIG. 5, the distal backside 5 is provided to include a point P2 defined at an intersection of a line A4 (a line orthogonal to a line A3 (a line connecting an outer end O2 of the wing edge 3A and the center of the steel pipe pile body 2) and extending through the center of the steel pipe pile body 2 toward the wing body 3B) and the steel pipe pile body 2. In other words, the distal backside 5 is located near the wing body 3B (at a rear side in the entering direction) in a manner intersecting a line orthogonal to a line connecting any point on the wing edge 3A and the center of the steel pipe pile body 2.

According to the steel pipe pile 1 as described above, an excavation resistance from the ground is applied on the wing edge 3A when the steel pipe pile 1 is rotationally driven into the ground. Accordingly, even when the steel pipe pile 1 tends to be rotationally moved (i.e. become off-centered), a resistance force is generated by the distal backside 5 pressed to the ground, thereby preventing the off-centered movement. Specifically, as shown in FIG. 4, when a rotation moment for rotating the entirety of the steel pipe pile 1 in a direction indicated by an arrow with the base end O1 of the wing edge 3A at the center, since the distal backside 5 is located on the line A2 (front side in the rotary direction), a pressing force from the ground is applied on the distal backside 5 as a resistance against the rotational movement, thereby keeping the entirety of the steel pipe pile 1 from being off-centered. Further, as shown in FIG. 5, even when a rotation moment is applied on the entirety of the steel pipe pile 1 with the outer end O2 of the wing edge 3A at the center, the resistance force caused by the distal backside 5 located on the line A4 at a front side in the rotational direction can keep the entirety of the steel pipe pile 1 from causing the off-centered movement. In other words, even when the rotation moment is applied with any point on the wing edge 3A at its center, since the distal backside 5 is formed to include the points P1 and P2, the resistance against the rotational movement can be applied, thereby efficiently preventing the off-centered movement of the entirety of the steel pipe pile 1.

When installing the steel pipe pile 1, the steel pipe pile 1 is initially driven downward by hitting a pile head with a hammer or using a pile driver and the like to stick an end of the distal backside 5 into the ground so that the steel pipe pile 1 is positioned in the ground. Then, the rotation of the steel pipe pile 1 is initiated. Subsequently, the wing 3 is entered into the ground and is pressed in downward in accordance with the drive distance, whereby the steel pipe pile 1 is penetrated into the ground. When the steel pipe pile 1 is thus penetrated, since the slanted opening 4 is located at the front side of the wing edge 3A in the entering direction, the excavated soil can be easily introduced into the steel pipe pile body 2 through the slanted opening 4 and the introduced soil can be pushed upward in the steel pipe pile body 2 for avoiding clogging within the pipe. Specifically, since the slanted opening 4 is opened up to the point higher than the distal end 2B of the steel pipe pile body 2 by the distance L2, the volume of the soil introducible through the slanted opening 4 (introducible soil amount) can be made larger than the volume of the soil determined based on the sunken amount of the steel pipe pile 1 and an internal cross sectional area of the steel pipe pile body 2 (required introduced soil amount). Thus, the soil loosened by the excavation with the wing 3 can be introduced into the steel pipe pile body 2 and can be pushed toward an upper side in the steel pipe pile body 2 without compaction, so that clogging in the pipe can be avoided and increase in press-in resistance can be restrained.

According to the above exemplary embodiment, the following advantages are obtainable.

Since the distal backside 5 is provided on the rear side of the wing edge 3A in the entering direction, when the steel pipe pile 1 is rotationally driven into the ground, the distal backside 5 resists against (i.e. offsets) the rotation moment around the wing edge 3A. Thus, while avoiding the off-centered movement and ensuring linearity, the steel pipe pile 1 can be penetrated into the ground. Further, since the slanted opening 4 is provided at the front side of the wing edge 3A in the entering direction, the soil excavated in accordance with the rotational drive into the ground can be smoothly introduced into the steel pipe pile body 2 through the slanted opening 4. Thus, while restraining the ground resistance in accordance with the entering, the soil introduced into the steel pipe pile body 2 can be pushed upward, thereby reducing an increase in the penetration resistance caused by clogging within the pipe. Accordingly, since the increase in the penetration resistance can be restrained while avoiding the off-centered movement of the steel pipe pile 1, the installation efficiency can be improved.

Incidentally, it should be understood that the scope of the invention is not limited to the above-described exemplary embodiment(s) but includes other arrangements and the like as long as the other arrangements and the like are compatible with the invention, where the following modifications and the like are also included in the scope of the invention.

For instance, though the slanted opening 4 is provided by cutting the steel pipe pile body 2 with a plane slanted relative to the axial direction X of the steel pipe pile 1 in the above exemplary embodiment, the slanted opening 4 is not limited to those provided by linear cutting, but may alternatively be provided by cutting along suitable curve lines or curved surfaces.

Further, though the helical wing 3 in the above exemplary embodiment is exemplified by a wing continuously provided from an end of the steel pipe pile body 2 to a pile head to define a spiral with a plurality of turns, the wing may be provided by only one spiral (i.e. one turn) on the steel pipe pile body 2 or may alternatively be continually provided. Though the width B of the wing 3 is not specifically limited, the width B is preferably from one third to a half of the diameter D of the steel pipe pile body 2 in terms of entering performance.

Though one of the best modes for implementing the invention has been described in the above exemplary embodiment, the scope of the invention is not limited thereto. In other words, while the invention has been particularly explained and illustrated mainly in relation to a specific exemplary embodiment, a person skilled in the art could make various modifications in terms of shape, material, quantity or other particulars to the above described embodiment without deviating from the technical idea or any object of the invention.

Accordingly, any descriptions of shape or material or the like disclosed above are given as examples to enable easy understanding of the invention, and do not limit the invention, so that descriptions using names of components, with any such limitations of shape or material or the like removed in part or whole, are included in the invention.

The invention claimed is:

1. A steel pipe pile comprising:

an elongated cylindrical steel pipe pile body with an open end; and a helical wing fixed on an outer circumference of the steel pipe pile body at a predetermined height range from the open end of the steel pipe pile body, the steel pipe pile body being rotationally driven to be penetrated into a ground, wherein the wing comprises:

a wing edge extending outward from the outer circumference of the steel pipe pile body; and a wing body extending continuously with the wing edge and extending helically along the outer circumference of the steel pipe pile body and toward an upper end of the steel pipe pile body opposite the open end of the steel pipe pile body, the open end of the steel pipe pile body comprises:

a slanted opening that is slanted in a radial direction of the steel pipe pile body from a distal end of the open end of the steel pipe pile body to an upper end of the slanted opening located a predetermined distance from the distal end of the steel pipe pile body; and a distal backside that is defined by a remaining circumference of the steel pipe pile body which does not include a circumference of the slanted opening, wherein the upper end of the slanted opening is beyond the wing edge relative to the distal end, and the distal backside has a point along a first line which is orthogonal to a second line connecting the wing edge and an axial center of the steel pipe pile body, the point being positioned closer to the wing body than to the slanted opening, a part of the distal backside at the distal end of the steel pipe pile body defines an arc on a plane orthogonal to an axial direction of the steel pipe pile body, a length from a lower surface of the wing edge to the open end of the steel pipe pile body is defined to be equal to or larger than a half of a width of the wing, and the lower surface of the wing edge is spaced from the slanted opening at the outer circumference of the steel pipe pile body.

2. The steel pipe pile according to claim 1, wherein a perimeter of the steel pipe pile body at the open end with the slanted opening is equal to or less than half a perimeter of the steel pipe pile body at a location without the slanted opening.

3. The steel pipe pile according to claim 1, wherein the upper end of the slanted opening is located in an area of the steel pipe pile body at a distance from one to three times as long as a diameter of the steel pipe pile body from the open end of the steel pipe pile body.

4. The steel pipe pile according to claim 1, wherein the wing edge extends from the outer circumference of the steel pipe pile body at a location that is spaced from the slanted opening along the outer circumference of the steel pipe pile body in a helical direction of the helically-extending wing body.

* * * * *